US011299384B2

(12) United States Patent
Walton et al.

(10) Patent No.: US 11,299,384 B2
(45) Date of Patent: Apr. 12, 2022

(54) BAG-IN-KEG CONTAINER WITH FIXED PRESSURE PRV

(71) Applicants: Philip Andrew Walton, Bishop Auckland Durham (GB); Sergio Sonzogni, Bergamo (IT)

(72) Inventors: Philip Andrew Walton, Bishop Auckland Durham (GB); Sergio Sonzogni, Bergamo (IT)

(73) Assignee: POLYKEG S.R.L.

( * ) Notice: Subject to any disclaimer, the term of this patent is extended or adjusted under 35 U.S.C. 154(b) by 0 days.

(21) Appl. No.: 17/291,366

(22) PCT Filed: Nov. 8, 2019

(86) PCT No.: PCT/GB2019/053178
§ 371 (c)(1),
(2) Date: May 5, 2021

(87) PCT Pub. No.: WO2020/095069
PCT Pub. Date: May 14, 2020

(65) Prior Publication Data

US 2021/0395067 A1 Dec. 23, 2021

(30) Foreign Application Priority Data

Nov. 9, 2018 (GB) ..... 1818332

(51) Int. Cl.
*B67D 1/04* (2006.01)
*B67D 1/08* (2006.01)
(Continued)

(52) U.S. Cl.
CPC ..... *B67D 1/0462* (2013.01); *B65D 77/06* (2013.01); *B65D 77/225* (2013.01);
(Continued)

(58) Field of Classification Search
CPC .... B67D 1/0462; B67D 1/0832; B67D 1/125; B67D 2001/0828; B67D 1/0831;
(Continued)

(56) References Cited

U.S. PATENT DOCUMENTS 5,110,012 A * 5/1992 Scholle ..... B67D 1/1252 222/83.5
5,199,609 A * 4/1993 Ash, Jr. ..... B67D 1/0406 141/114
(Continued)

FOREIGN PATENT DOCUMENTS

NL 1011570 9/1999
WO WO 9947451 9/1999
(Continued)

*Primary Examiner* — Frederick C Nicolas
(74) *Attorney, Agent, or Firm* — Galbreath Law Offices, P.C.; John A. Galbreath

(57) ABSTRACT

A bag-in-keg container for a carbonated beverage has a container body C, a flexible bag B within the container body, and a valve closure V attached to the container body. The valve closure includes a gas inlet port (11), a liquid dispensing port (12), and spring-loaded valve member (6) to sealably close the gas inlet and liquid dispensing ports. An adapter (20) sealingly attached to the flexible bag B incorporates a bag PRV (26) to vent gas pressure from within the flexible bag. A container PRV (40) vents gas pressure from between the container body C and the flexible bag B. The bag PRV has a valve shuttle with one side exposed to gas pressure within the flexible bag B and an opposite side exposed to gas pressure within a sealed plenum chamber (37). The bag PRV therefore operates at a fixed pressure independent of the differential pressure between the bag and the outer container. This solves the problem of venting excess pressure within the keg whilst still allowing the dispensing gas to achieve the equilibrium.

8 Claims, 4 Drawing Sheets

(51) Int. Cl.
*B67D 1/12* (2006.01)
*B65D 77/06* (2006.01)
*B65D 77/22* (2006.01)

(52) U.S. Cl.
CPC ..... *B67D 1/0832* (2013.01); *B67D 1/125* (2013.01); *B67D 2001/0828* (2013.01)

(58) Field of Classification Search
CPC .... B67D 1/1252; B67D 1/0802; B65D 77/06; B65D 77/225; F16K 1/36; F16K 1/306; F16K 1/307; F16J 15/164; F16J 15/32
See application file for complete search history.

(56) References Cited

U.S. PATENT DOCUMENTS 5,356,045 A * 10/1994 Parks ..... B67D 1/0802 220/214
5,415,329 A * 5/1995 Westlund ..... B67D 1/0832 222/397
6,089,415 A * 7/2000 Terpstra ..... B67D 1/0838 137/212
6,311,875 B1 * 11/2001 Anderson ..... B67D 1/0832 222/396
2006/0180605 A1 * 8/2006 Priebe ..... B67D 1/0054 222/1
2012/0187153 A1 * 7/2012 Burge ..... B67D 1/0462 222/386.5
2015/0108175 A1 * 4/2015 Wauters ..... B67D 1/125 222/400.7
2020/0307982 A1 * 10/2020 Walton ..... B67D 1/0831
2021/0139306 A1 * 5/2021 Wolter ..... B67D 1/0838
2021/0347625 A1 * 11/2021 Valles ..... B67D 1/0835
2021/0371267 A1 * 12/2021 Walton ..... B67D 1/0832

FOREIGN PATENT DOCUMENTS

WO WO 2005113416 12/2005
WO WO 2013159159 10/2013
WO WO 2015150833 10/2015

* cited by examiner

BAG-IN-KEG CONTAINER WITH FIXED PRESSURE PRV

TECHNICAL FIELD OF THE INVENTION

This invention relates to bag-in-keg containers, and more particularly, to pressure relief valves for use in such containers.

BACKGROUND

Kegs, containing carbonated beverages are, due to the nature of carbonated beverages, under internal pressure. This pressure is dependent on the level of carbonation (amount of dissolved $CO_2$) and the temperature of the beverage. If the $CO_2$ content and/or temperature of the keg is too high, excessive pressures can be generated within the keg. Furthermore, some beer brewers use a post-fermentation process where fermentation and hence $CO_2$ generation can continue after initial filling. If this process is not carefully controlled, it is again possible for the internal pressure to become too high. Keg manufacturers sometimes therefore incorporate a pressure relief device which allows gas to vent if the internal pressure rises above a predetermined level, thus preventing excessive over-pressure.

An increasing volume of carbonated beverages is being transported in so-called bag-in-keg containers in which the product is held in a flexible bag within an outer relatively rigid container. Bag-in-keg containers therefore effectively have two containers, one inside the other. Filling and emptying of most beer kegs is carried out by way of a valve closure which is screwed onto the neck of the outer container. Such closures are configured to enable the liquid contents to be dispensed by gas pressure. A gas inlet port allows a dispense gas to be introduced under pressure, which in the case of a bag-in-keg container, enters a space between the inner bag and the outer container. The increased internal pressure causes the liquid product to flow out of a liquid dispensing port via a draw tube which removes liquid from the bottom of the bag. Depending on the type of valve closure, various spring-loaded valve arrangements are provided to sealably close the gas inlet and liquid dispensing ports before the product is dispensed.

The internal bags are generally of a thin non-structural membrane material and are connected (usually by welding) to the valve closure via a structural adapter. As the surface of the bag is physically constrained by the walls of the outer container, forces generated inside the bag due to the pressure of it's contents are directly transferred to the outer wall of the keg. In this case, a pressure relief valve in the outer keg wall will not relieve the pressure generated within the bag and an over pressure situation will occur.

WO 2015 150 833-A1 discloses a stretch blow moulded keg in which miniature pressure relief valve (PRV) is contained within the wall thickness of the neck to release gases on the occurrence of an over-pressure event. In bag-in-keg containers it is proposed that a bag PRV is mounted in the wall of the structural adapter to vent internal pressure from within the bag into the gas space between the adapter and the neck of the container. A pressure relief valve works due to a pressure difference across it. Therefore, if the additional pressure relief valve is configured to open with a pressure difference of say 5 bar, it will open when the internal bag pressure rises above 5 bar and the pressure between the bag and the keg is 0 bar. However, as this gas vents into the gas space between the bag and the keg, this pressure here will also rise. Thus, the pressure inside the bag at which the neck PRV opens will rise by the same amount. If, for example, the pressure between the bag and the keg is at 3 bar, then the internal bag pressure will need to be 8 bar before the 5 bar pressure differential is achieved.

At this point it is important to note that the pressure required to effectively dispense the carbonated beverage must be higher than the equilibrium pressure of the carbonated beverage otherwise gas will leave the beverage reducing its level of carbonation. Therefore, if the bag PRV is set at 5 bar then the PRV venting the space between the bag and the outer container must be at least 5 bar to maintain carbonation. As already explained, it is the sum of these two pressures that determines the maximum internal pressure, so if for example the bag has a pressure release value of 5 bar and the space between bag and keg also has a pressure release value of 5 bar then the maximum internal pressure is in fact 10 bar (5+5=10), which is not acceptable.

SUMMARY OF THE INVENTION

When viewed from one aspect the present invention proposes bag-in-keg container:

- a container body (C);
- a flexible bag (B) within the container body;
- a valve closure (V) attached to the container body:
  - a closure body (1)
  - a gas inlet port (11),
  - a liquid dispensing port (12),
  - valve means (6) to sealably close the gas inlet and liquid dispensing ports;
- an adapter (20) sealingly attached to the flexible bag (B) and connected to the valve closure (V);
- a bag PRV (26) to vent gas pressure from the flexible bag into a dispensing gas space (S) between the container body (C) and the flexible bag (B);
- a container PRV (40) to vent gas pressure from the dispensing gas space (S);
  - characterised in that the bag PRV (26) has a valve element (34) having one side exposed to gas pressure within the flexible bag (B) and an opposite side exposed to gas pressure within a sealed plenum chamber (37).

In a preferred embodiment the valve element (34) controls a PRV outlet port (33) and comprises a shuttle with spaced seals (35, 36).

In a preferred embodiment the sealed plenum chamber (37) is part of the bag PRV (26). The valve element (34) may be spring loaded against the action of the gas pressure within the flexible bag (B) by a compression spring (38) which is located within the plenum chamber (37).

In a preferred embodiment the bag PRV (34) is mounted in the adapter (20).

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
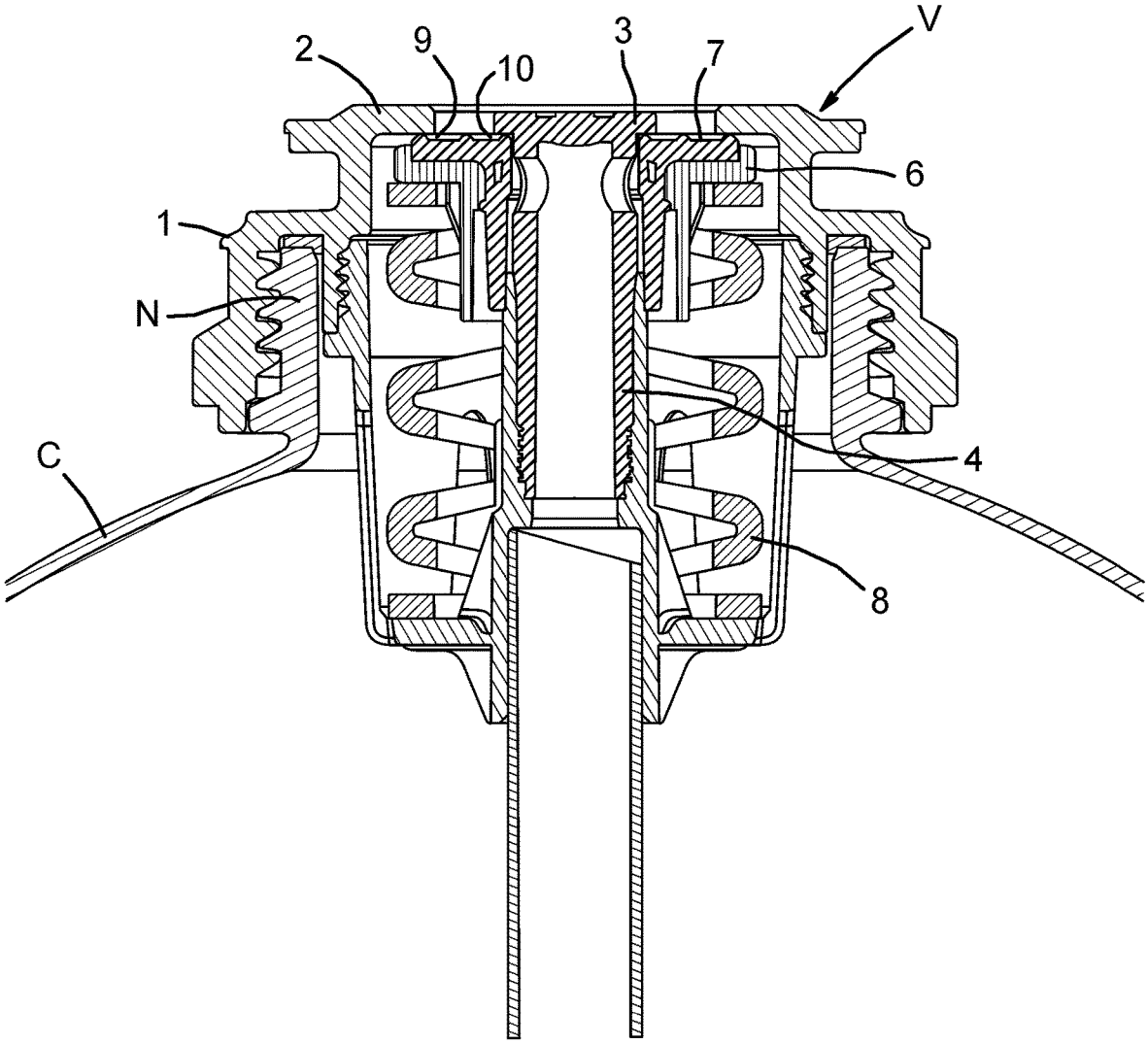
FIG. 1 is an axial section through an A-type valve closure shown in a closed configuration.

For the purpose of example the valve closure shown in the drawings is of the kind known as an A-type valve. All components of the valve closure may be moulded of polymeric materials (plastics) so that the closure is fully recyclable. A preferred form of valve closure is described in EP 2 585 400 A1.

Figure 2:
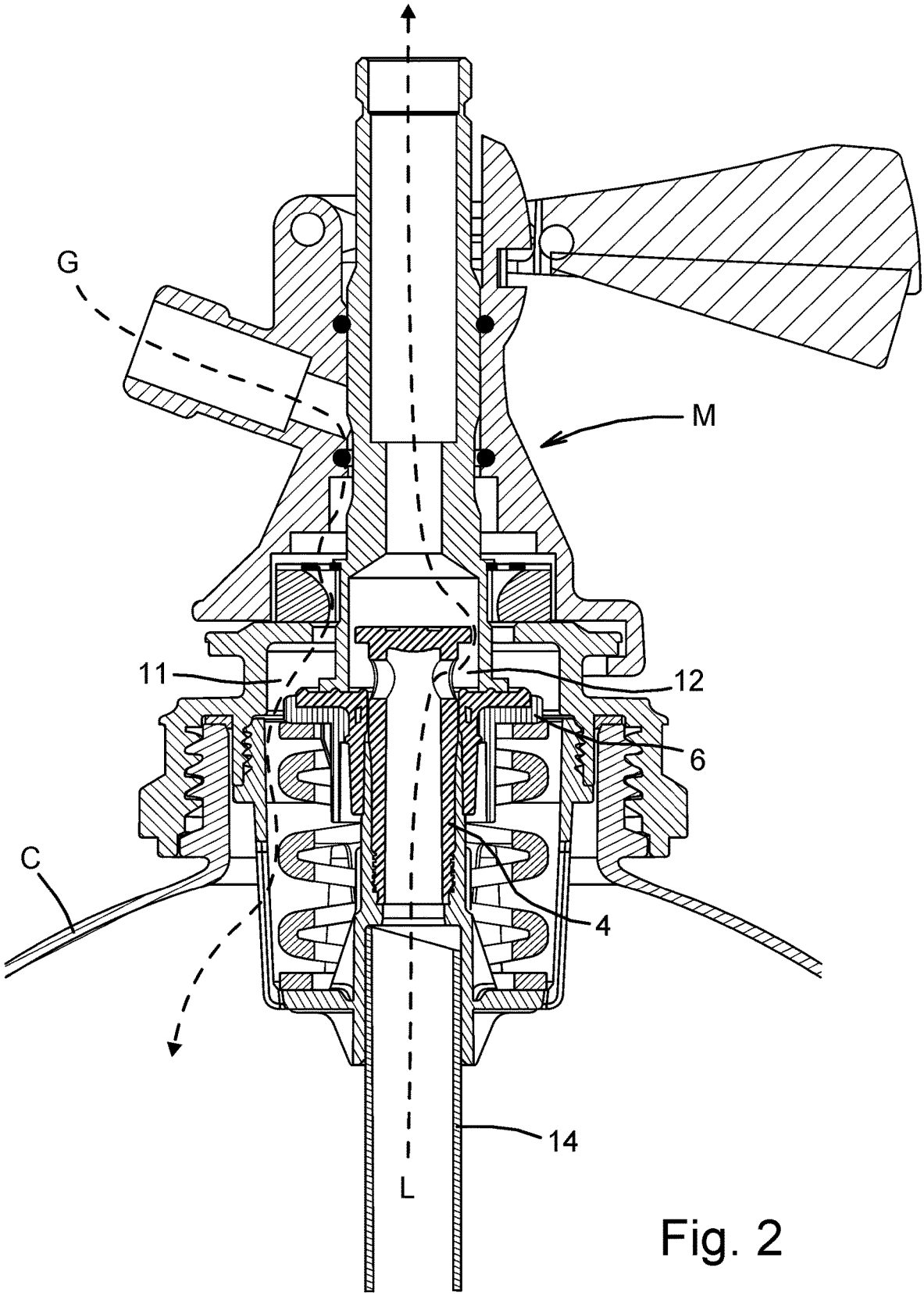
FIG. 2 is a similar axial section through the A-type valve closure shown in the dispensing configuration.

Referring firstly to FIG. 1, the valve closure V comprises a closure body 1 which is adapted to be fitted onto the neck N of a beverage container C such as a beer keg, which is typically formed by stretch blow moulding. The closure body has an annular top wall 2 which is concentric with a fixed disc-shaped cap 3 formed at the upper end of a hollow core pin 4. A valve member 6 includes a resilient seal 7 and is spring-loaded by a compression spring 8 which sealingly urges the valve member against an outer valve seat 9 formed around the inner periphery of the annular top wall 2 and an inner valve seat 10 formed around the periphery of the cap 3. To dispense a liquid product from the container the valve member 6 is engaged by a cylindrical valve-operating member M as in FIG. 2. The valve member 6 is depressed against its spring-loading and makes sealing contact with the valve-operating member M to provide separate gas and liquid flow paths past the valve-operating member, indicated by the broken arrows G and L respectively. Pressurised gas is fed into the container C through a gas inlet port 11. Liquid simultaneously flows out of the container through a draw tube 14 and the core pin 4, exiting through a liquid dispensing port 12. When dispensing is finished and the valve-operating member M is disconnected, the valve member 6 returns to the sealing condition shown in FIG. 1, holding the internal gas pressure within the container together with any remaining liquid.

Figure 3:
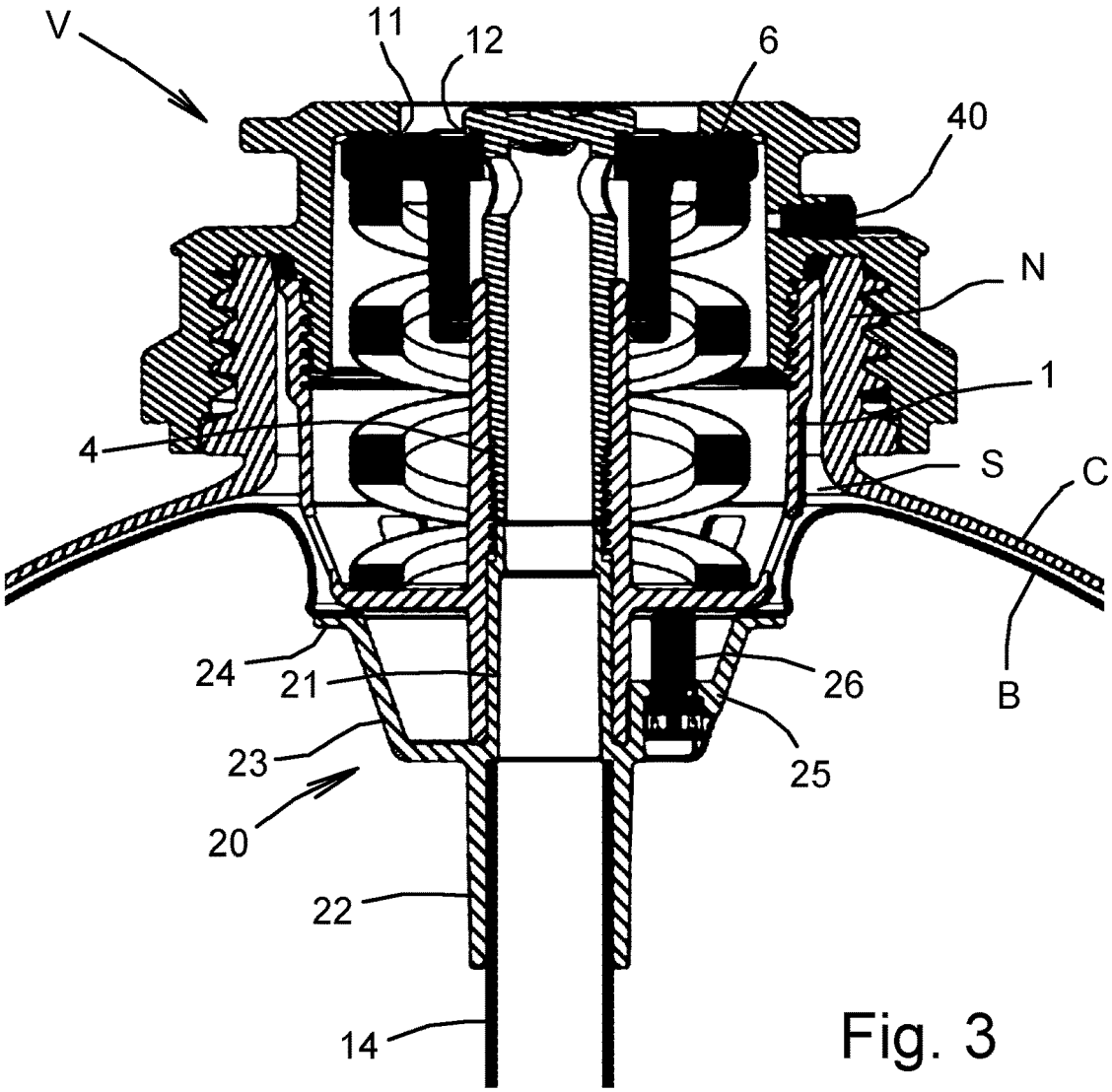
FIG. 3 is an axial section through a similar valve closure as used in a bag-in-keg container.

In bag-in-keg containers the carbonated product is held within an inner flexible bag B, as shown in FIG. 3. The bag B is formed of a thin impermeable non-structural membrane which is sealingly connected, e.g. by welding, to an adapter 20. This adapter includes an upper cylindrical portion 21 which is inserted through the bottom of the valve closure V to connect with the core pin 4. A lower cylindrical portion 22 connects with the upper end of the draw tube 14. A generally conical connecting wall 23 extends outwards and upwards from the cylindrical portions 21 and 22, ending in an annular flange 24 to which the bag membrane B is sealingly attached. The conical wall 23 incorporates a housing 25 for a bag PRV 26 which is arranged to vent gas from within the upper part of bag B into the gas space S between the bag B and the outer container C. Furthermore, a container PRV 40 is mounted in the wall of the closure body 1 above the neck N of container C.

At this point it should be noted that when the flexible bag B is fully pressurised as shown in the drawings there is little or no physical space between the bag and the outer container, but there will still be gas contained within communicating spaces such as between the valve closure V and the neck N. For present purposes such spaces are considered to be part of the space S between the bag and container.

Figure 4:
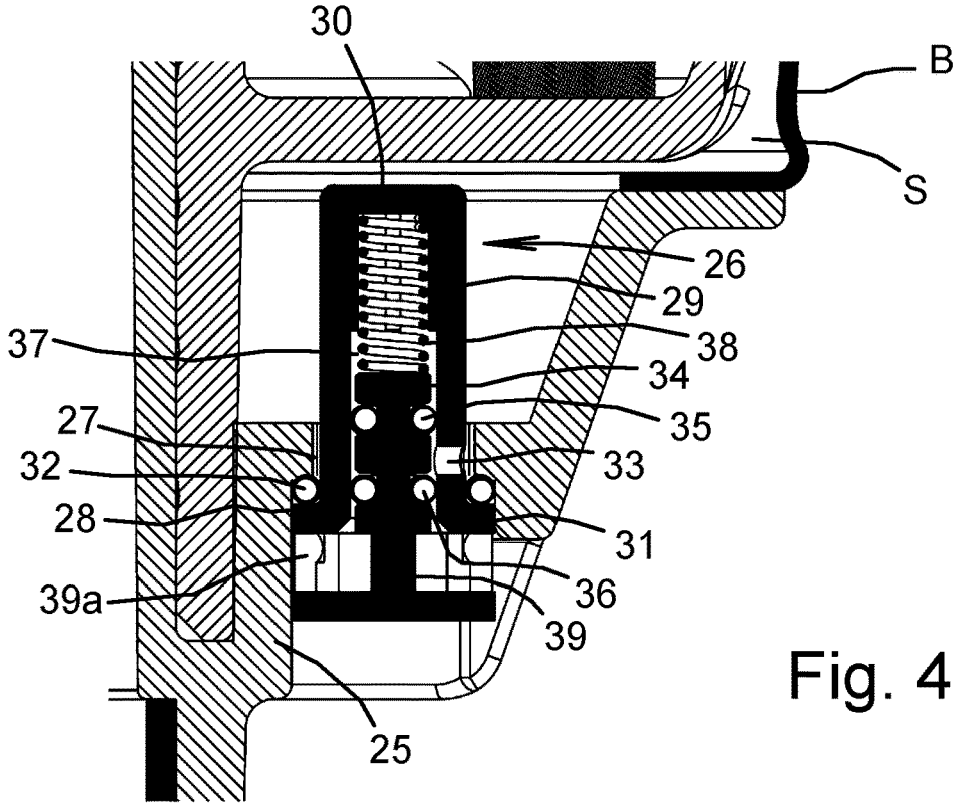
FIG. 4 is an axial section through the valve closure showing a detailed section through the bag PRV.

Referring to FIG. 4, the housing 25 for the bag PRV incorporates a generally cylindrical aperture 27 which is stepped outwardly at the lower end 28, opening to the interior of the bag B. The bag PRV 26 has a hollow generally cylindrical body 29 which is closed at the upper end by a top wall 30. The lower end of the PRV body 29 is open, with an outwardly-extending flange 31 which is sealably received in the lower end 28 of aperture 27 by a ring seal 32. The body of the PRV has an outlet port 33 which opens into the space S between bag B and container C via the aperture 27. The PRV body 29 contains a PRV valve element in the form of a shuttle 34, which is axially slidable within the PRV body. The shuttle is provided with spaced upper and lower ring seals 35 and 36. The upper ring seal 35 forms a sealed plenum chamber 37 between the shuttle 34 and the top wall 30. A compression spring 38 within the plenum chamber bears against the top wall 30, urging the shuttle 34 against an end stop 39 which is joined to the PRV body 29 by webs 39*a*. In this rest position the upper and lower ring seals 35 and 36 are located on opposite sides of the outlet port 33, thereby sealably closing the outlet port and preventing gas from leaving the bag.

Figure 5:
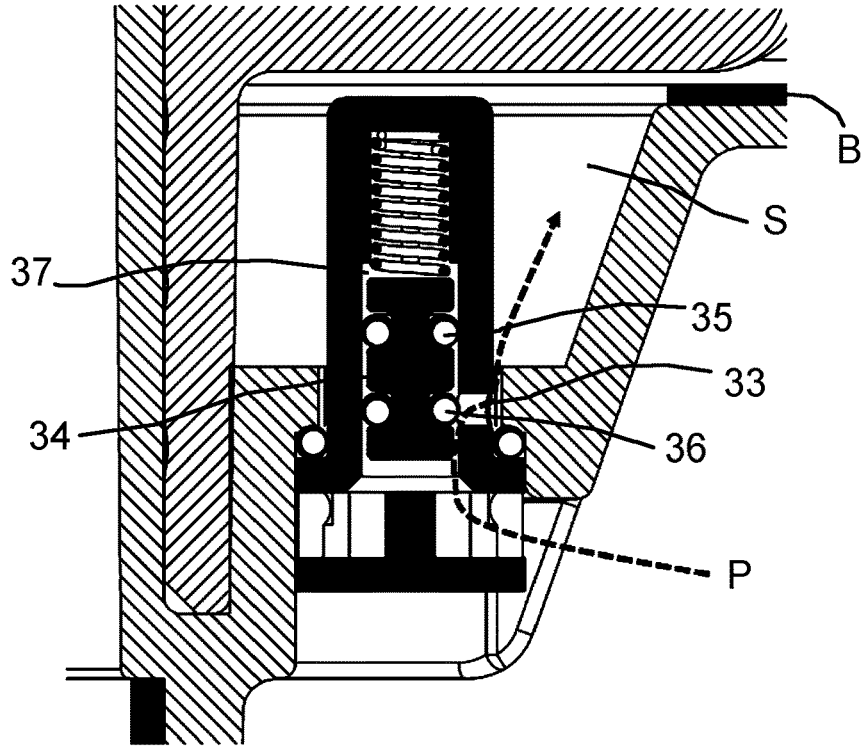
FIG. 5 is a similar axial section showing the bag PRV in a venting position.

The pressure within the sealed plenum chamber 37 is set, and spring 38 is calibrated, to allow movement of the shuttle 34 when a predetermined gas pressure (e.g. 5 bar) acts on the opposite end of the shuttle via the open lower end of the bag PRV. Referring to FIG. 5, when the shuttle 34 moves under the influence of increasing internal pressure within the bag B, the upper ring seal 35 maintains closure of the sealed plenum chamber 37 while the lower ring seal 36 moves past the outlet port 33 thus relieving the internal pressure of the bag into the dispensing gas space S between the bag B and the outer container C. The vent path is indicated in the drawing by the broken arrow P. As the pressure is relieved, the spring moves the shuttle back out of the plenum chamber 37 so that the lower ring seal 36 once again closes the outlet port 33.

Because the internal plenum chamber of the PRV 26 remains sealed it is not influenced by changes in pressure in the space S between the bag and the outer container. Therefore as the pressure is relieved into the space S the relief pressure of the bag remains substantially constant, as determined by the preset opening pressure of the PRV.

Figure 6:
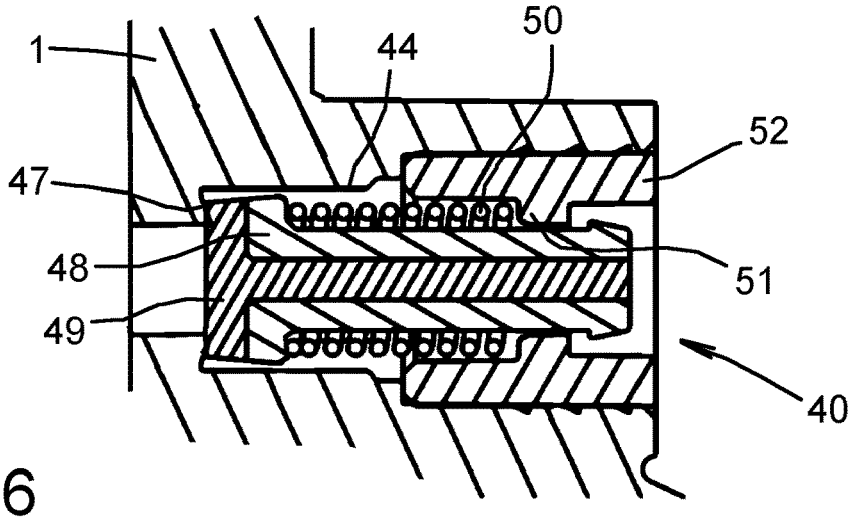
FIG. 6 is an axial section through the valve closure showing a detailed section through the container PRV.

The container PRV 40 is, in turn, arranged to vent the space S between the bag B and the container C. This second PRV may be of a conventional configuration. By way of example, as shown in FIG. 6, the container PRV 40 is received in a generally cylindrical aperture 44, the lower end of which is stepped inwardly to form a seat 47. A valve plunger 48 incorporating a resilient valve seal 49 is received within the aperture 44 and urged into sealing contact with the seat 47 by a compression spring 50. The opposite end of the spring 50 bears against a shoulder 51 formed within a retaining ring 52 which is screw-threaded or otherwise engaged within the outer end of the aperture 44. When the internal gas pressure within the dispensing gas space S between the bag B and container C exceeds the predetermined set pressure of the container PRV, e.g. 5 bar, the plunger 48 is lifted off its seat 47, allowing gas to pass through the body 1 of the valve closure and venting the excess pressure from within the container.

As the pressure rises in the space S between the bag and the outer container, the bag PRV 26 can open at it's preset relief pressure, and is unaffected by the pressure within the gas space S. Thus, if both PRVs are calibrated for example at 5 bar, the maximum pressure anywhere in the system will be limited to 5 bar.

This solves the problem of venting excess pressure within the keg whilst still allowing the dispensing gas to achieve the equilibrium pressure of the carbonated beverage, i.e. by providing a bag PRV that operates at a fixed pressure independent of the differential pressure between the bag and the outer container.

It is important for the correct operation of the bag PRV that the closed plenum chamber does not have any significant leakage over the working life of the keg. Any pressure loss, or high pressure gas entering the plenum chamber, will change the calibration of the relief pressure. It is also desirable that the materials used to construct the enclosing parts of the PRV are relatively impermeable over the life of the keg, and are able to withstand the gas pressures generally found within kegs.

The bag PRV described herein is mounted in the wall of the bag adapter 20. However it could be mounted anywhere in the effective wall of the bag provided the PRV outlet is positioned to access the space S between the bag and the keg.

The venting mechanism can be applied to all the common valve formats A, G, S, D and M types. An A-type valve is similar to a G-type valve. Both have a fixed central core pin and a single spring-loaded valve member which controls two ports. Other forms of valve closure are also used with beer kegs. Operationally, S, D and M types are similar to each other in that they all have no fixed central core pin but have two concentric spring-loaded moving valve members which separately control the two ports. Generally the valve members are operated by respective spring elements, but the valve members may be cascaded such that closure of one spring-loaded valve member causes closure of the other.

Whilst the above description places emphasis on the areas which are believed to be new and addresses specific problems which have been identified, it is intended that the features disclosed herein may be used in any combination which is capable of providing a new and useful advance in the art.

The invention claimed is:

1. A bag-in-keg container:

a container body (C);

a flexible bag (B) within the container body;

a valve closure (V) attached to the container body:

a closure body (1)

a gas inlet port (11), a liquid dispensing port (12), valve means (6) to sealably close the gas inlet and liquid dispensing ports (11 and 12);

an adapter (20) sealingly attached to the flexible bag (B) and connected to the valve closure (V);

a bag pressure relief valve (26) to vent gas pressure from the flexible bag into a dispensing gas space (S) between the container body (C) and the flexible bag (B);

a container pressure relief valve (40) to vent gas pressure from the dispensing gas space (S);

characterised in that the bag pressure relief valve (26) has a valve element (34) having one side exposed to gas pressure within the flexible bag (B) and an opposite side exposed to gas pressure within a sealed plenum chamber (37).

2. A bag-in-keg container according to claim 1 wherein the valve element (34) controls a pressure relief valve outlet port (33).

3. A bag-in-keg container according to claim 2 wherein the valve element (34) comprises a shuttle (34).

4. A bag-in-keg container according to claim 3 wherein the shuttle (34) has spaced seals (35, 36).

5. A bag-in-keg container according to claim 1 wherein the valve element (34) is spring loaded against the action of the gas pressure within the flexible bag (B).

6. A bag-in-keg container according to claim 5 wherein the valve element (34) is spring loaded by a compression spring (38).

7. A bag-in-keg container according to claim 6 wherein the compression spring (38) is located within the plenum chamber (37).

8. A bag-in-keg container according to claim 1 wherein the bag pressure relief valve (34) is mounted in the adapter (20).

* * * * *